US005545092A

United States Patent [19]

Johnson et al.

[11] Patent Number: 5,545,092

[45] Date of Patent: Aug. 13, 1996

[54] SPECIAL EFFECTS SPARK GENERATING SYSTEM

[75] Inventors: Steven A. Johnson, Valencia; Christian P. Bodden, Glendale, both of Calif.

[73] Assignee: The Walt Disney Company, Burbank, Calif.

[21] Appl. No.: 260,541

[22] Filed: Jun. 16, 1994

[51] Int. Cl.[6] ..... A63G 31/00; A63J 23/00

[52] U.S. Cl. ..... 472/66; 472/65; 446/22; 431/276

[58] Field of Search ..... 472/57, 66, 65; 431/276, 273; 362/159; 446/22; 40/427, 430, 442; 219/78.02, 85.16, 76.13, 76.1

[56] References Cited

U.S. PATENT DOCUMENTS

| | | | |
|---|---|---|---|
| 1,653,701 | 12/1927 | Guerard . | |
| 1,781,516 | 11/1930 | Malkin . | |
| 2,198,177 | 4/1940 | Pohlhaus | 446/22 |
| 3,377,739 | 4/1968 | Michelman et al. | 446/22 |
| 3,556,703 | 1/1971 | Florjancic . | |
| 4,231,734 | 11/1980 | Burns . | |

*Primary Examiner*—Kien T. Nguyen
*Attorney, Agent, or Firm*—Poms, Smith, Lande & Rose, P.C.

[57] ABSTRACT

A system and method for generating special effects showers of sparks for use in theme park shows and rides. A flint rod is biased with fluid pressure against a cutting wheel of this system. When a clutch is actuated for a brief predetermined time period, a constant high speed motor is operatively connected to the cutting wheel, rapidly rotating it. The rotating wheel cuts, ignites and discharges small portions of the flint rod biased thereagainst away therefrom in a stream of sparks. An air stream directs the stream of sparks out as a special effects shower of sparks. One embodiment of this system propels the spark stream out through a venturi nozzle. By changing the gas stream fluid pressure and/or the clutch connect time and/or the flint rod biasing pressure and/or the clutch connect/disconnect interval timing, the size and characteristics of the shower of sparks can be accurately controlled and altered as desired. It can be made to simulate showers of sparks produced in electrical shortings or those from metal-to-metal impacts. The position of the impact end of the flint rod relative to the cutting wheel can be easily adjusted to prolong the operating life of the wheel.

26 Claims, 7 Drawing Sheets

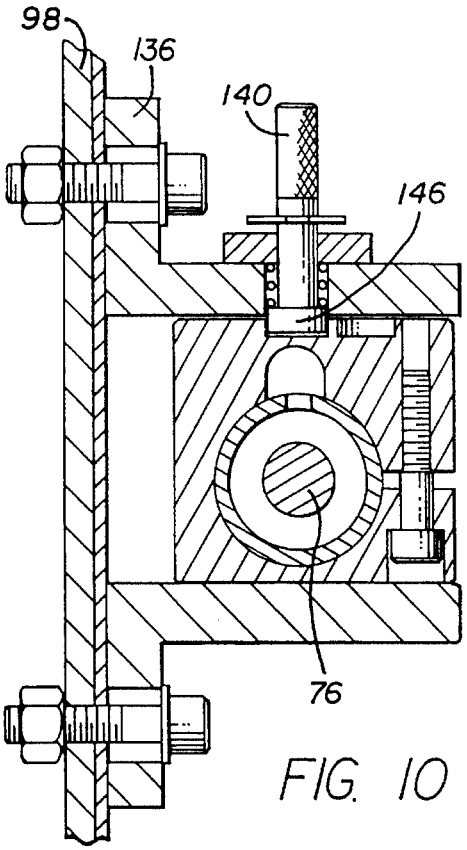
FIG. 10
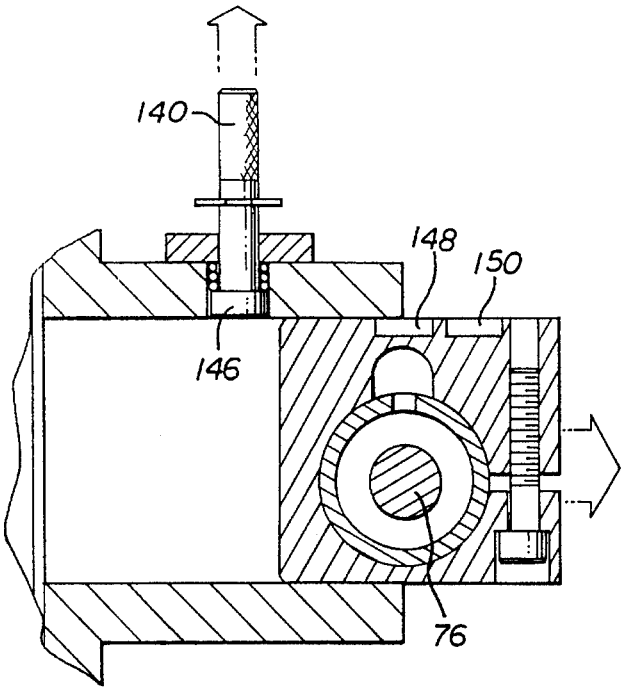
FIG. 11
FIG. 12
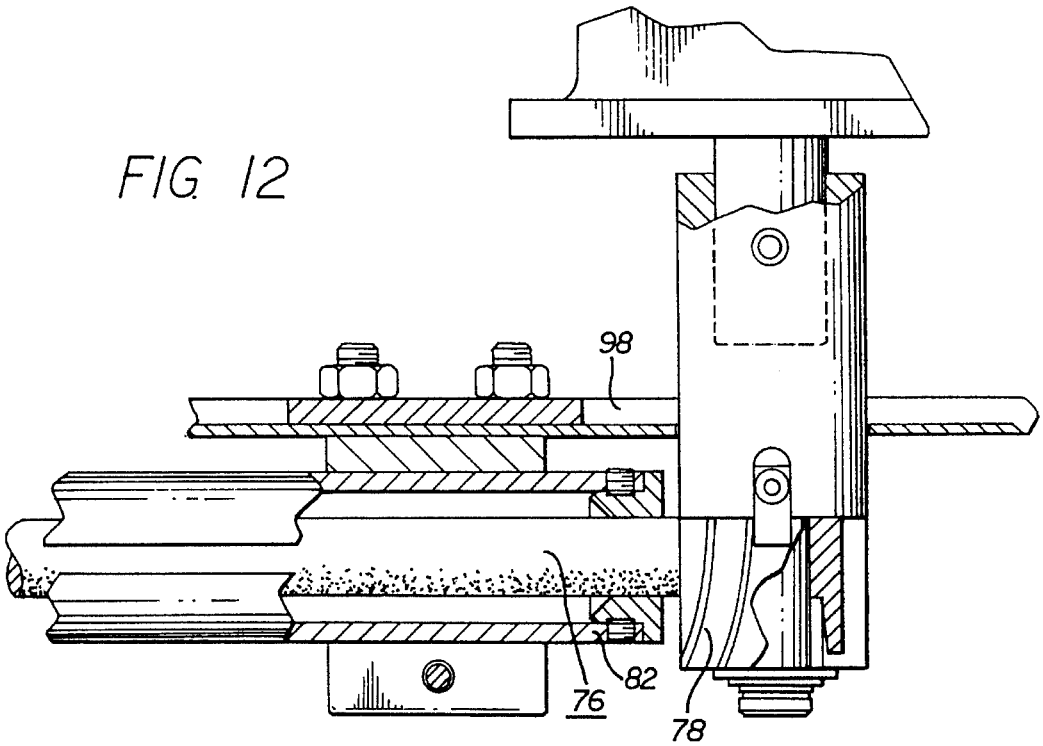

SPECIAL EFFECTS SPARK GENERATING SYSTEM

BACKGROUND OF THE INVENTION

The present invention relates to systems for generating special effects sparks for shows, theme park rides and the like. These sparks, for example, can simulate sparks generated in a large electrical short or those generated by the friction of metal-to-metal impact.

A system known in the prior art for generating special effects sparks for theme park rides and shows is shown in FIGS. 1 and 2 generally at 30. Referring thereto, system 30 is shown to include a Molten Inert Gas (MIG) welder gun 32 which is operatively connected to a power control unit 34. A spool of titanium wire 36 held in the body of the gun is fed out the gun nozzle 38 during the operation thereof. The wire is fed out to a pulley 40, similar to those found on automobiles or lawn mowers, and which is rotated by an air motor 42 to which the pressurized air is fed through air lines 44 connected at their opposite ends to the control unit 34. The pulley 40 is grounded by a rocker arm or motor brush 50 and a ground wire 52. This grounding is important since the gun 32 is at a much higher voltage and amperage potential than is the pulley 40. While the pulley 40 is at ground, the wire via the gun 32 is at between seventy-five and two hundred amps and between five and fifteen volts.

As the wire is fed out of the gun 32 it explodes when it hits the rotating pulley 40. This is because it is trying to weld onto it but it cannot because the pulley 40 forms a rapidly moving surface. That is, instead of welding to the pulley 40, molten wire sparks are produced. Compressed air is blown out through a nozzle 54 towards these sparks propelling them away in a stream or shower. In other words, the compressed air blows the small fragments of molten slag produced as the wire is vaporized out into the air.

By changing the type and size of wire on the spool 36 a different character of sparks can be produced. The shower of sparks can also be varied by adjusting the air pressure from nozzle 54. Additionally, the shower effect can be varied by varying the amperage of the MIG gun 32 and/or by increasing the speed of the wire feed out therefrom.

There are a number of problems with this spark generating system, including the costs of the wire itself. The main problem is that titanium slag builds up on the pulley 40. This requires that the pulley 40 either be replaced or that the slag be scraped off with a wire brush, both tasks being maintenance intensive. If too much slag builds up then the nozzle 54 blocks and the wire jams up in the gun 32. It is then necessary to go to the time and expense of replacing the tip of the nozzle 54 and unjamming the wire within the gun 32.

In addition to these expenses and maintenance problems, there is also a small safety hazard due to the electrical operation of the gun, though the shock potential is not great given the relatively low voltages used. The system 30 is also large and awkward, not fitting into small areas required in many shows.

It was also difficult with the prior art system 30 to not only maintain repeatability of spark characteristics through multiple cycling over long periods of time, but also to produce the desired spark characteristics in the first instance. Coarse sparks convincingly simulating the burning of parts in an electrical fire were very difficult if not impossible to produce with that system.

Other means known for producing "sparking" effects are shown in U.S. Pat. Nos. 1,653,701 ('701), 1,781,516 ('516) and 2,198,177 ('177). (These three patents and all other patents mentioned anywhere in this disclosure are hereby incorporated by reference in their entireties.) The '177 and 516 patents show toys producing only a few sparks each with each use thereof and certainly not the volume of sparks that are required to be viewed at a distance by audiences of theme park rides or shows. They may produce thirty or so pin-tip size sparks which travel out only a few inches or maybe a foot. Further, these sparking toys are not adapted to automatically and consistently produce sparks of certain characteristics and to be able to vary the spark shower. The '701 device shows a rotating grinder and a plurality of metal pieces applied simultaneously against the grinder to produce a sun-wheel fireworks type of luminous display. It does not simulate a shower of sparks, similar to those from electrical fires or train wrecks. It also does not propel the sparks out in a shower or allow for effective control and adjustment of the spark characteristics.

SUMMARY OF THE INVENTION

Directed to remedying the above-mentioned disadvantages of the prior art, improved systems for generating showers of special effects sparks (simulated sparks) for use in shows, theme park rides and the like are herein disclosed. Pursuant to this invention constant air pressure urges a flint rod against a static cutter wheel mounted to the system housing. When the spark shower is desired, an electric clutch is activated to engage the static cutter wheel to a constant high speed motor. The impact of the rod against the rotating cutter wheel generates a stream of sparks. The duration of this spark generation can be controlled by the length of time the clutch is engaged. Also, by adjusting the air pressure on the flint rod the magnitude and quantity of the sparks can be controlled. The type of sparks generated can also be controlled by the selection of the characteristics of the cutter wheel and flint rod used and by the frequency at which the clutch is repeatedly engaged and disengaged. The stream of sparks thereby generated is blown away by an air nozzle as a special effects shower of sparks in the desired direction and for the desired distance. The nozzle direction and air pressure arc also adjustable, and the same control signal that activates the clutch can be used to activate the air nozzle to provide a reliably timed display, which efficiently uses its power supplies.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 10 is an enlarged cross-sectional view taken on line 10—10 of FIG. 8;

FIG. 11 is a view similar to FIG. 10 showing the flint rod cylinder component in a releasing operation thereof;

FIG. 12 is an enlarged sectional view taken on line 12—12 of FIG. 8.

DETAILED DESCRIPTION OF PREFERRED EMBODIMENTS OF THE INVENTION

Figure 13:
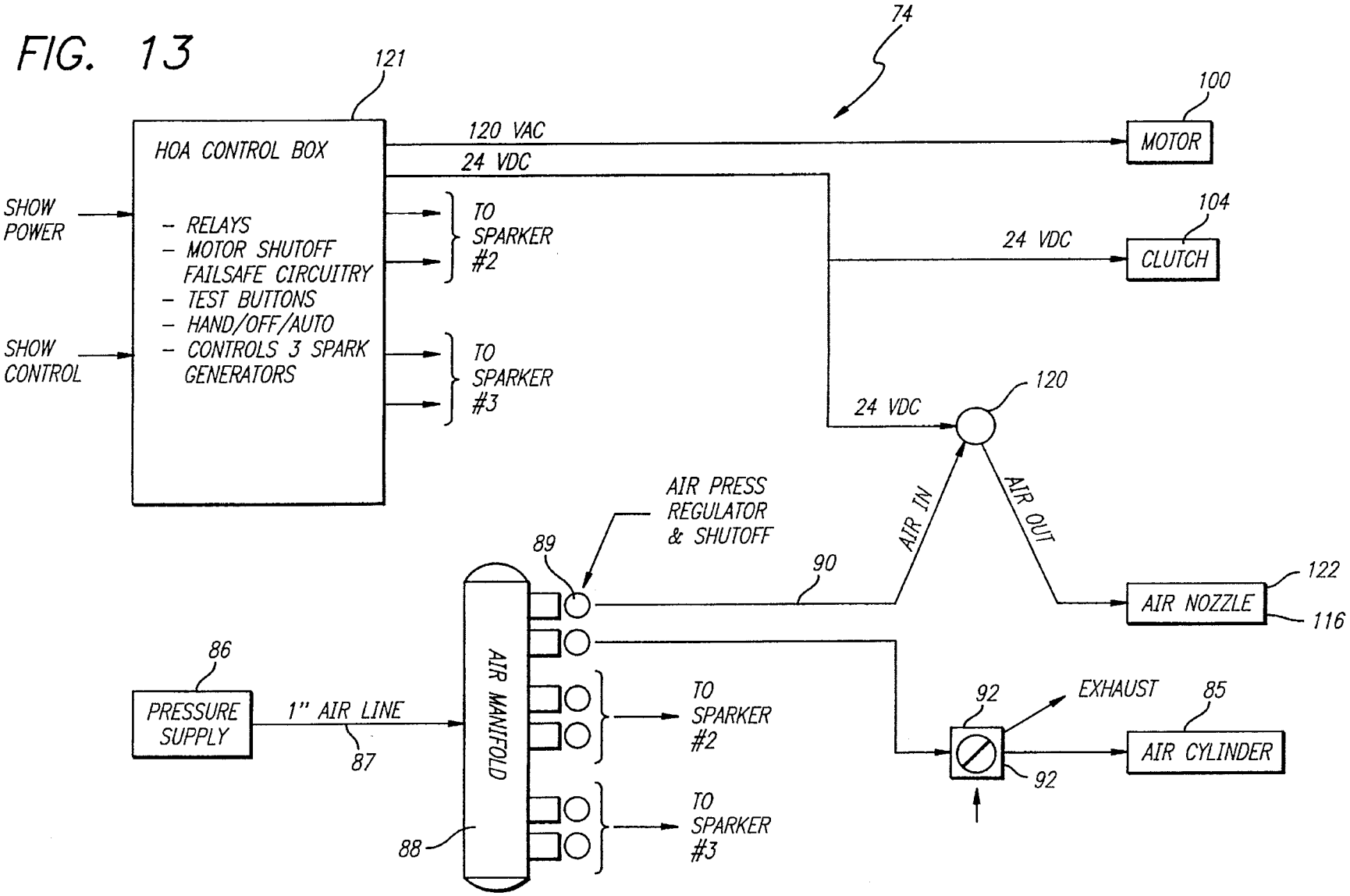
FIG. 13 is an electrical and air pressure schematic of the first or second systems shown used in a three-spark generating system theme show set-up.

Referring to FIGS. 3–12, two alternative systems of the present invention are illustrated. A first system is shown in FIGS. 3–6 generally at 70 and an alternative second system is shown in FIGS. 7–12 generally at 72. FIG. 13 shows generally at 74 a schematic of the electrical and air pressure hook-ups for either of these systems and particularly when included in a multi-unit set up. For example, the system of FIG. 13 shows three sparking systems being used such as might be used sequentially and/or simultaneously in a single theme park ride or show. Corresponding elements of both systems 70, 72 have been accorded the same reference numerals in this disclosure.

Figure 9:
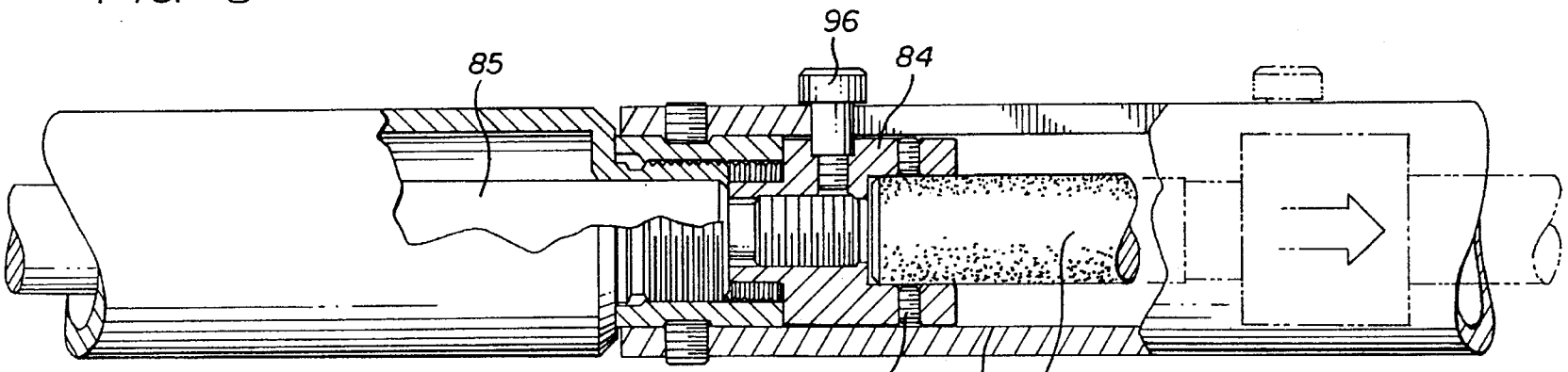
FIG. 9 is an enlarged sectional view taken on line 9—9 of FIG. 7.

Both of these systems 70, 72 generate sparks by using a cigarette lighter-type of principle, such as shown in U.S. Pat. Nos. 3,556,703 and 4,231,734. Briefly, an elongate flint rod 76 is biased against a cutter wheel 78 which is rotated at periodic intervals. When so rotated the end of the flint rod 76 is impacted by the flutes of the cutter wheel 78 causing small portions of the flint rod to be cut off, ignited and ejected away. The ejected chards continue to burn as they fall creating secondary explosions. This gives the spark shower a more dimensional appearance and the popping sound gives it a realistic audible effect simulating an electrical shorting. The size, number and frequency of the sparks and the direction and distance they are propelled out can be carefully controlled with this invention as will be explained below. The flint rod 76, which can have a length of three feet as shown by system 70 or one foot as shown by system 72 and a diameter of one-half inch, is made of a metallic and synthetic material such as that which is commercially available from the Treibacher Company of Germany. The rod 76 is housed in a long cylinder 82 and its proximal end is held in a plug or plunger 84, as shown in FIG. 9. As the plug 84 is pushed within and along the interior of the cylinder 82, the flint rod 76 is pushed with it towards the cutter wheel 78. The plug 84 has a tight fit within the cylinder 82 and it is biased or urged towards the cutter wheel 78 by the pressure within the air cylinder 85 on the other side. The pressure is supplied from a pressure supply 86, through a one-inch air line 87, as shown in FIG. 13, an air manifold 88, an air pressure regulator and shut-off valve 89, a small quarter-inch air line 90, a three-way air shut-off valve 92, and then to the air cylinder 85. During the operating time or cycle of the system (70, 72), the air pressure in the air cylinder 85 is constantly biasing the flint rod 76 against the cutter wheel 78. As can be appreciated, this air pressure to the air cylinder 85 can be changed as desired to adjust the sparking characteristics.

Referring to FIG. 9 it is seen that the flint rod 76 is being held at its proximal end by a plunger 84. A shoulder screw 96 extending up from the plunger 84 rides in a cylinder slide slot. This keeps the flint rod 76 from rotating relative to the cutter wheel 78, thereby insuring consistent sparking action. That is, through the plunger 84 the flint rod 76 is captured with set screws 98, pushed by the air cylinder 85, and prevented from rotating by the shoulder screw 96.

Within the housing 98 of the system(s) are a one hundred and twenty volt, thirty-eight hundred rpm motor 100, a gear box 102, and an electric clutch 104, such as that available from Inertia Dynamics of Connecticut. The motor 100 is always on and running during system performance. When it is desired to generate the sparks, the clutch 104 is activated through a control signal from the control box 108, causing the motor 100 to be drivingly connected through the gear box 102 to the cutter wheel 78, thereby rotating the cutter wheel. The cutter wheel 78 is only rotated for a very brief period of time. That is, the clutch engagement time might be for only one or two seconds or even less, such as for two-tenths of a second. The cutter wheel 78 thus may be rotated by this clutch engagement only one hundred and eighty or three hundred and sixty degrees. A single rotation can be suitable for producing sparks which simulate electrical sparks and a few rotations can simulate sparks generated from the impact of metallic objects. When the engagement time of the clutch 104 is for a very short period, the cutter wheel 78 does not reach its top speed. It ramps up, similar to an automobile clutch, to only half the speed of the motor 100 when the engagement time is one tenth of a second as might be used to produce electrical sparks. A full-second engagement though would bring the cutter wheel 78 up to full speed.

Thus, the flint rod 76 is always being pushed against the cutter wheel 78; the air pressure of the air cylinder 82 spring loads the flint rod against the cutter wheel. The cutter wheel 78 remains static as long as the clutch 104 is not engaged. As soon as the clutch 104 is engaged, the cutter wheel 78 comes quickly up to speed. The operating time and speed of the cutter wheel 78 are thereby very accurately and reliably controlled. Also, the air pressure spring-load on the flint rod 76 is accurately controlled, which results in a reliable, repeatable spark stream being generated.

The systems 70 and 72 can both produce hundreds or even thousands of sparks with each brief actuation thereof. Approximately ten to eighty percent of these sparks can be burning chards causing a secondary explosion or pop, thereby simulating an electrical-type of fire. Each of the chards can have a sixteenth inch or larger diameter and having a flake or oval-type of shape. They continue to burn as they fall to the ground and can explode a second time, by a very visible secondary explosion. Also, because of the cutting action of the wheel 78 on the flint rod 76 a tremendous amount of smoke is produced which advantageously adds to the electrical fire effect.

Electrical sparks in an actual shorting event tend to spread out a large distance over a long period of time. The sparks have a slow, lazy action; they pop and then sort of arc out in several different directions. In contrast, friction sparks typically are a more narrow shower of sparks, all going in the same direction and with a greater velocity. With the system 70 or 72 set to simulate electrical sparks, to simulate friction sparks the following adjustments thereto would be made to the system. The air pressure in the cylinder 85 would be decreased from, as an example, about twenty psi to about ten psi and the clutch would be engaged for a longer time of five seconds instead of one-tenth second. Also, a cutter wheel 76 which has more of a grinding action instead of cutting action could be installed. As discussed below a venturi nozzle, space permitting, would be used to propel the sparks further than a simple air assist.

Figure 1:
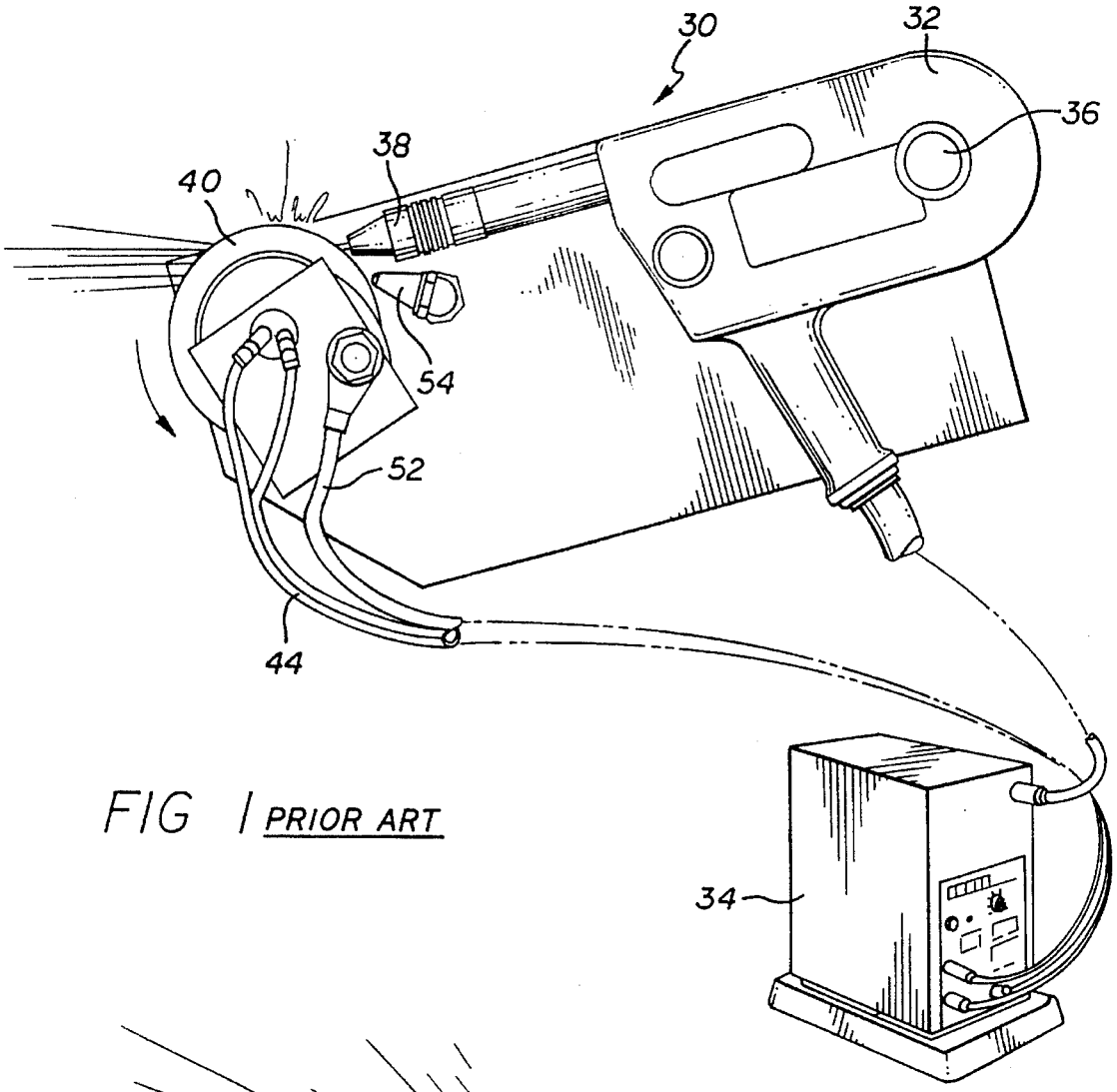
FIG 1 PRIOR ART
FIG. 1 is a perspective view of a spark generating system of the prior art.
Figure 2:
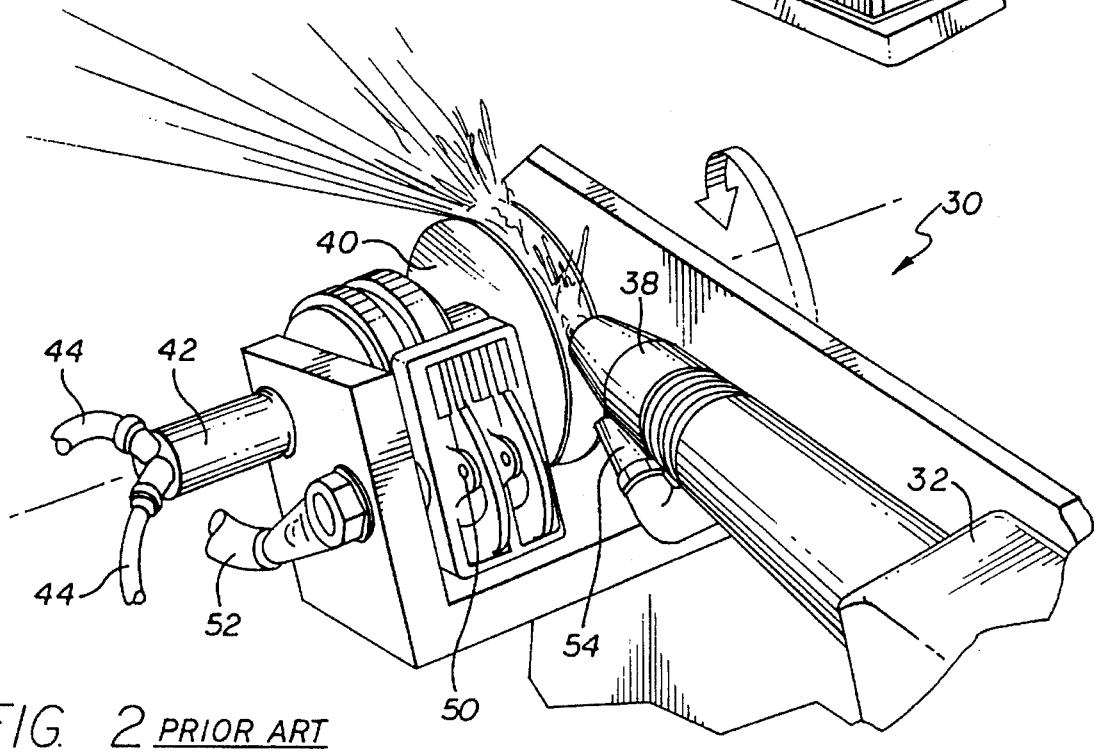
FIG. 2 PRIOR ART
FIG. 2 is an enlarged perspective view of the prior art system of FIG. 1.
Figure 3:
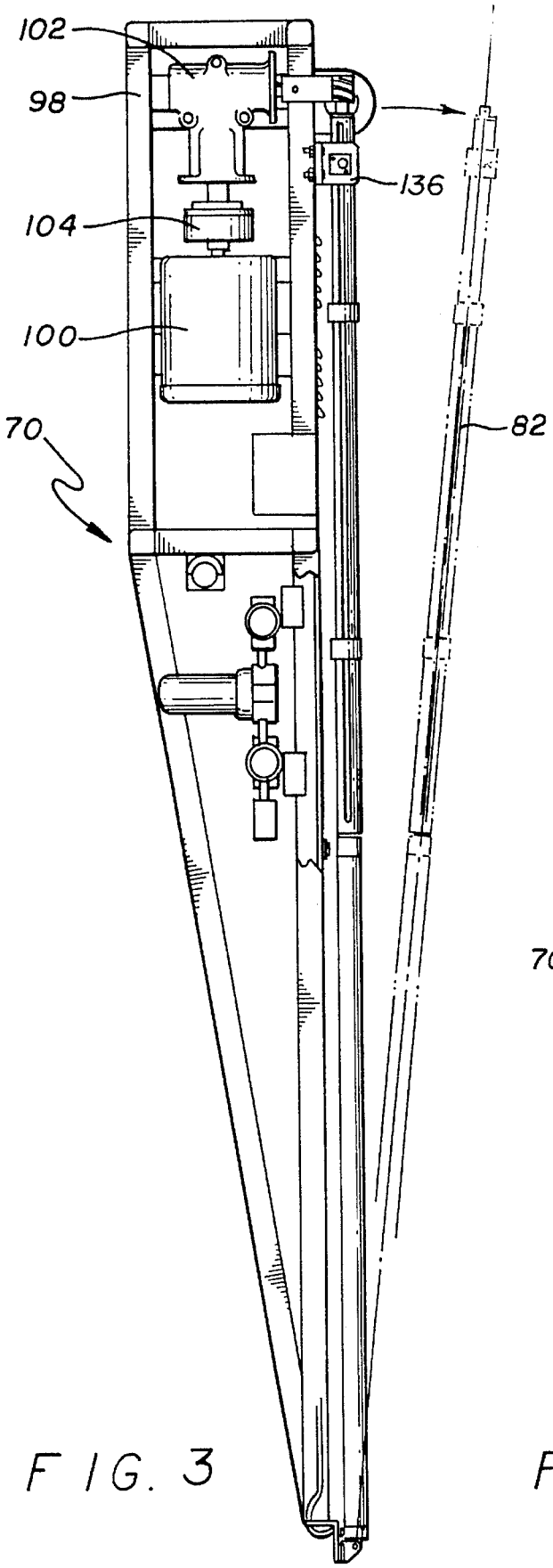
FIG. 3 is a side elevational view of a first special effects spark generating system of the present invention.
Figure 4:
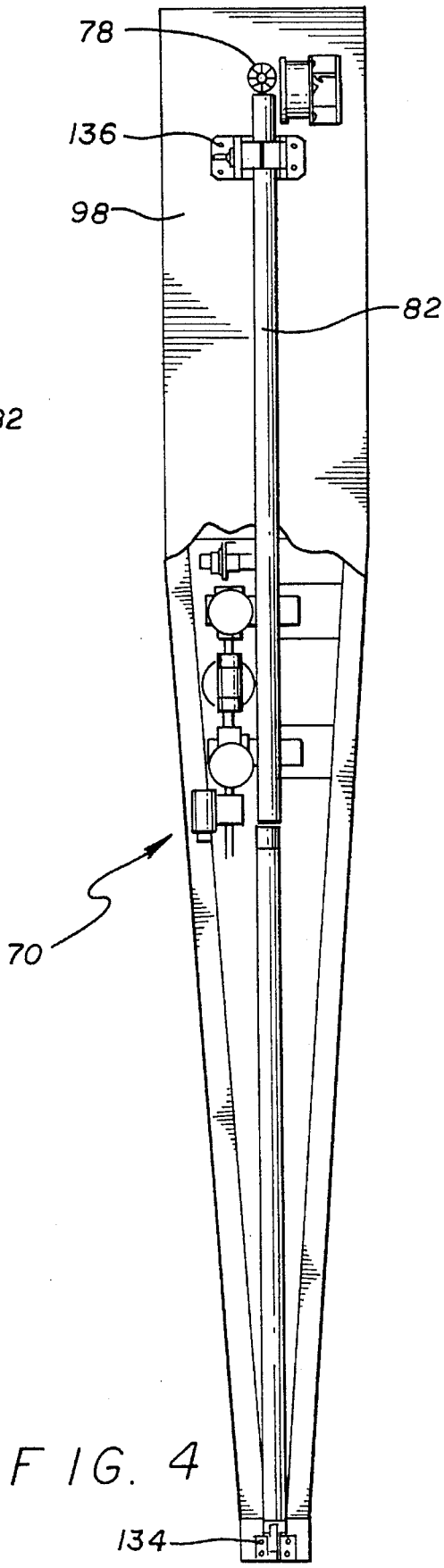
FIG. 4 is a front elevational view of the first system.
Figure 5:
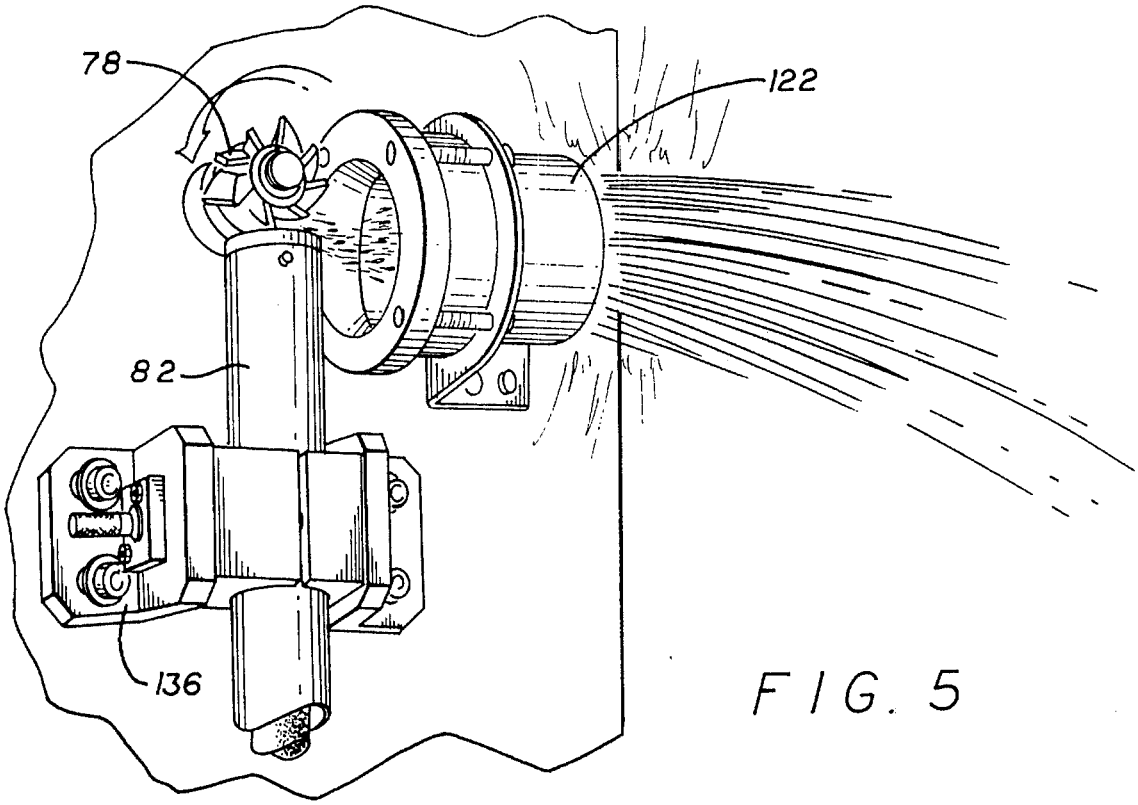
FIG. 5 is an enlarged perspective view of the spark-shower portion of the first system.
Figure 6:
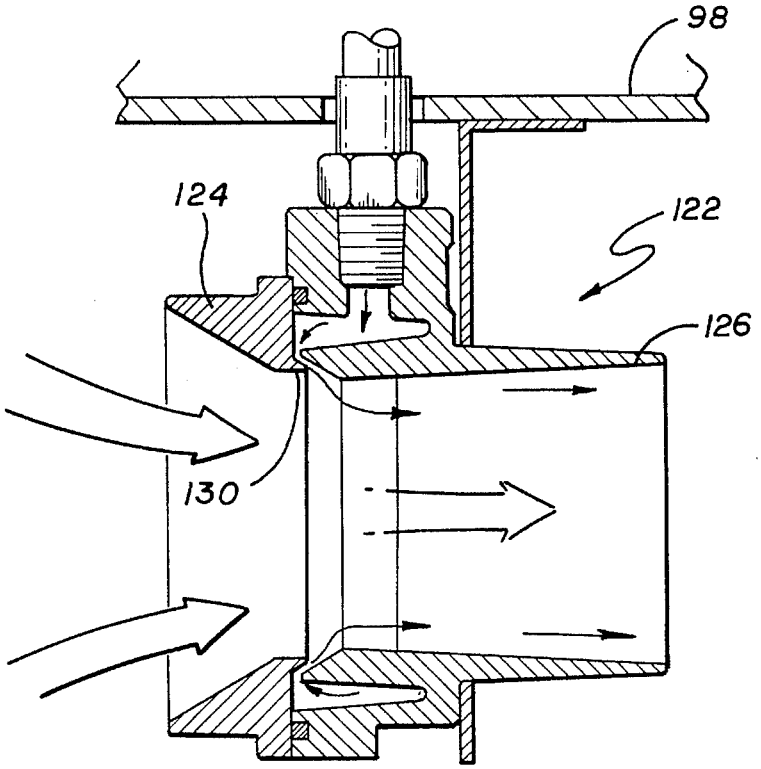
FIG. 6 is an enlarged cross-sectional view of the venturi nozzle of the sparkshoe portion of FIG. 5.
Figure 7:
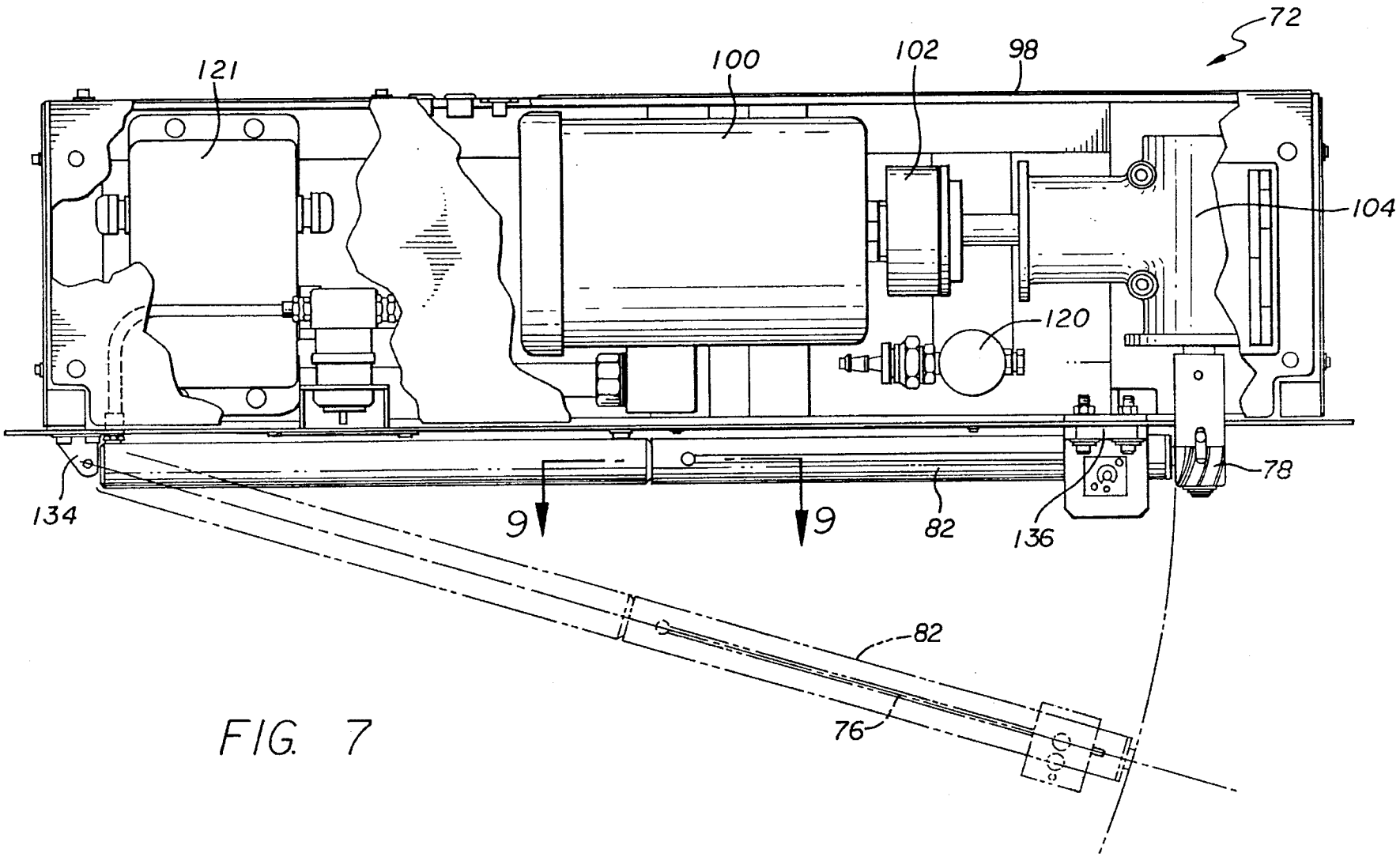
FIG. 7 is a side elevational view of a second special effects spark generating system of the present invention with portions thereof broken away to illustrate internal components thereof.
Figure 8:
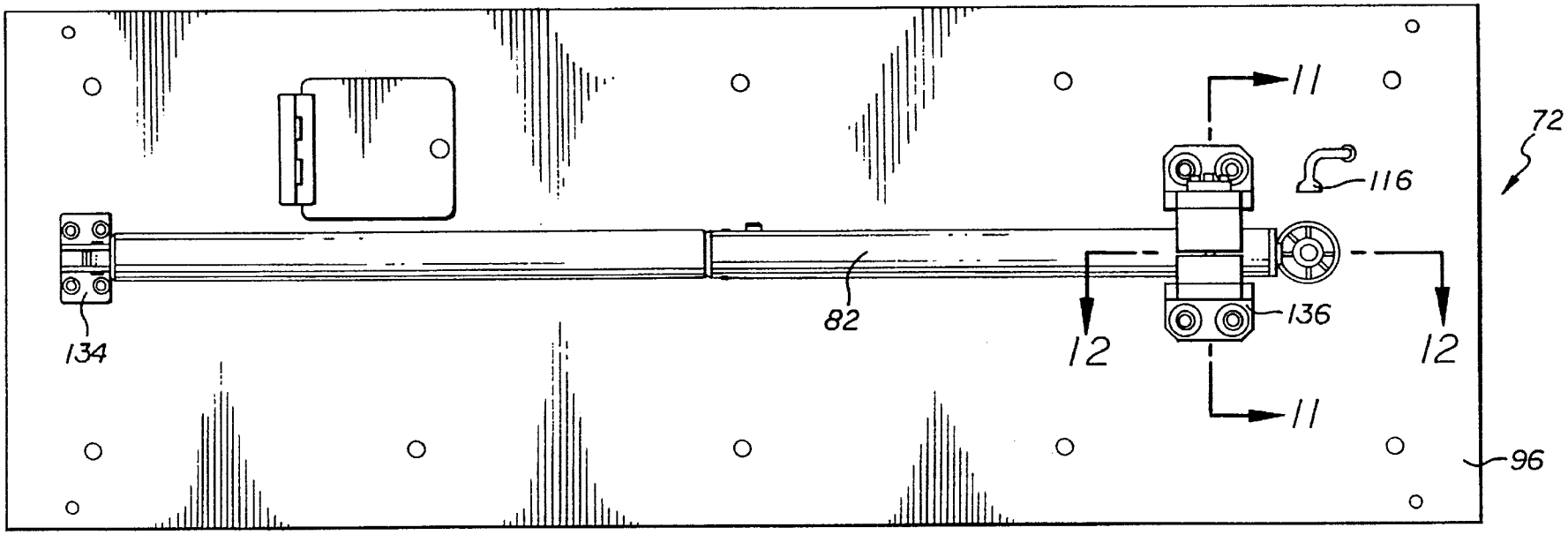
FIG. 8 is a front elevational view of the second system.

As the sparks are propelled off the cutter wheel 78 in a stream, they are caught up in gas stream which directs the sparks out perhaps one to ten feet in the desired direction. The actuation of the pressure of this gas stream out through a jet assist or nozzle 116, as shown in FIG. 8, can be controlled using an air solenoid 120, which is actuated simultaneously with or with the same control signal as that of the actuation of the clutch 104, and as instructed by the control box 121. The first system 70 shows instead of assist 116 a venturi nozzle 122 used for shooting the stream of sparks out a distance (perhaps fifteen to twenty feet) in the desired shower effect, as shown in FIGS. 5 and 6. It is seen therein that the sparks enter the large converging inlet 124 to the nozzle where they are caught up in the pressurized gas stream, injected circumferentially into the interior of the nozzle and then propelled out a diverging outlet 126. An example of a venturi nozzle which can be used is a "Transvector" nozzle such as is available from Vortec. Briefly, it is an air flow amplifier which uses a small amount of compressed air to move large volumes of air. That is, it accelerates the large mass of stationary air with a thin sheet of sonic velocity compressed air. A lip 130 at the orifice of the compressed air into the nozzle interior deflects the compressed air down the throat of the nozzle 122 where it collides with surrounding air and accelerates a large mass of air towards the outlet 126. In other words, the compressed air causes not only an induced air flow into the inlet of the nozzle 122 but also a rapid flow of air with the sparks therein out the exit of the nozzle to shoot the sparks out a long distance in the desired direction and with the desired velocity.

The second system 72 is a more compact system than is the first system 70 and is used where there are space constraints. In contrast, the first system 70 is advantageous because it has the longer flint rod (providing a longer operating time between rod replacements) and it incorporates the venturi nozzle 122. The system 74 shown in FIG. 13 would be different or altered, depending upon whether it is the first or second system which is used, as follows. The clutch and air solenoid would have their own twenty-four Volt DC control whereas on the original system they are tied together.

The proximal end of the cylinder 82 is pivotally coupled to the housing by a pair of ears or brackets 134. At its opposite end, proximate to the cutter wheel 78 as shown in FIG. 5 for example, the cylinder 82 is held between forward brackets 136 bolted to the housing 96. When unlocked, by pulling outward on a spring biased pin 140, as can be seen by comparing FIGS. 10 and 11, the cylinder 82 is free to be pulled out from its brackets 136 and swung to a position away from the housing as shown by the dotted line representation thereof in FIG. 7. This allows for replacement of the flint rod, by loosening the set screws 98.

As seen in FIGS. 10 and 11, the engagement head 146 of the spring biased pin 140 can fit into either of two detents or openings 148, 150 in the cylinder 82. When the pin head 146 is in one opening 148 the flint rod 76 is in a first axial position relative to the cutter wheel 78 whereby the flint rod impacts it at a first area of the cutter wheel. Then when the pin 140 is pulled out, the cylinder 82 aligned with the other opening 150 and the pin released therein, the flint rod 76 is at a second axial orientation with respect to the cutter wheel 78 thereby causing impact wear on the cutter wheel at a second area of the cutter wheel. By switching the pin head 146 between the two openings 148, 150, wear on the cutter wheel 78 is switched from one location thereof to another thereby prolonging the operating life of the cutter wheel. As an example, the operating life may be doubled such as from three months to six months. This not only saves the cost of replacing the cutter wheel 78 itself but the labor involved in replacing it. The replacement, since it would not be as frequent, would not interfere as often with the operation of the sparking system 70 or 72 and thereby the ride or show of which it is an integral part.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A special effects spark generating system, comprising:

a cutting wheel;

a constant motor;

clutch means for drivingly engaging, for a brief predetermined time period, said motor to said cutting wheel, to thereby rotate said cutting wheel for the time period;

a flint rod axially biased against said cutting wheel such that when said cutting wheel is rotated, for the time period by said motor, said cutting wheel cuts, ignites and discharges portions of said flint rod away therefrom in a stream of sparks; and pneumatics means for directing the stream of sparks out as a special effects shower of sparks.

2. A special effects spark generating system, comprising:

a rotatable assembly;

an elongate sparker member; and fluid pressure biasing means for biasing with fluid pressure said sparker member axially against said rotatable assembly with said rotatable assembly rotating to thereby produce a special effects shower of sparks;

wherein the amount of the fluid pressure and the axial biasing time of said biasing means are both generally independently adjustable to thereby controllably adjust the size of the shower of sparks.

3. The system of claim 2 wherein said rotatable assembly comprises a rotatable cutter wheel and said sparker member comprises a flint rod.

4. A special effects spark generating system, comprising:

a nozzle having a nozzle inlet and a nozzle outlet;

spark generating means for generating a stream of sparks towards said nozzle inlet; and injecting means for injecting a pressurized air stream into said nozzle to thereby propel the stream of sparks out said nozzle outlet as a special effects shower of sparks.

5. The system of claim 4 wherein said injecting means injects the pressurized air stream directly into said nozzle and between said nozzle inlet and outlet.

6. The system of claim 4 wherein said injecting means and said nozzle comprise together a venturi air entrainment amplifier.

7. A special effects spark generating system, comprising:

sparking means, including a rotating component and a sparker rod, for generating a stream of sparks as said sparker rod is biased against said rotating component; and gas propelling means, including a venturi nozzle, for propelling with pressurized gas the stream of sparks through and out said venturi nozzle as a special effects spark shower.

8. A special effects spark generating method, comprising the steps of:

biasing with fluid pressure an elongate sparker member against a striker assembly;

rotating the striker assembly and thereby generating a stream of sparks from the impact of the rotating assembly and the sparker member biased thereagainst; and propelling with air pressure the stream of sparks out and away from the striker assembly and as a special effects shower of sparks.

9. The method of claim 8 wherein when said rotating step commences, the sparker member is biased against the striker assembly.

10. The method of claim 9 wherein said rotating step includes drivingly engaging the striker assembly to a constant high speed motor.

11. A special effects spark generating system, comprising: a rotatable striker assembly having different first and second portions;

a sparker rod which when in a sparking position and struck by said striker assembly, when rotating, generates a shower of sparks; and mounting means for mounting said rod in alternative different first and second positions relative to said striker assembly, such that when said rod is in the first position it is biased against said striker assembly in a sparking position and causes primary striker wear in said first portion of said striker assembly when said striker assembly is rotated, and such that when said rod is in the second position it is also in a sparking position and causes primary striker wear in said second portion of said striker assembly when said striker assembly is rotated, such that by moving said rod from the first position to the second position the operating life of said striker assembly is extended.

12. The system of claim 11 further comprising fluid pressure biasing means for biasing said sparker rod into the sparking position relative to said striker assembly.

13. The system of claim 12 wherein the fluid pressure of said fluid pressure biasing means is adjustable to controllably adjust the size of the shower of sparks.

14. The system of claim 13 wherein the striking time of said sparker rod against said rotating striker assembly is adjustable to controllably adjust the size of the shower of sparks.

15. The system of claim 14 further comprising a constant high speed motor and clutch means for drivingly connecting said striker assembly to said constant motor for an adjustable time period corresponding to the adjustable striking time.

16. The system of claim 11 wherein said mounting means includes first and second spaced openings defining at least in part the first and second positions, respectively.

17. The system of claim 16 wherein said mounting means includes a positioning member associated with said rod and positionable alternatively in said first and second openings to thereby mount said rod in said alternative first and second positions.

18. The system of claim 17 wherein said positioning member comprises a spring-biased pin.

19. The system of claim 16 wherein said first and second openings are in a housing which houses said rod.

20. The system of claim 11 further comprising a constant high speed motor and a clutch drivingly connecting said striker assembly to said motor for a desired spark generating time.

21. A special effects spark generating method, comprising the steps of:

urging a flint rod against a rotating cutting wheel and thereby generating a stream of sparks;

propelling with fluid pressure the stream of sparks out and away from the striker assembly as a special effects shower of sparks; and adjusting the rotation time of the cutting wheel and the urging force of the flint rod against the rotating cutting wheel to thereby controllably adjust the size of the stream of sparks.

22. The method of claim 21 wherein the stream of sparks comprises a first stream of sparks, and further comprising after said generating step and with the flint rod remaining urged against the cutting wheel, discontinuing the rotation of the cutting wheel, and thereafter, resuming the rotation of the cutting wheel and thereby generating a second stream of sparks.

23. The method of claim 22 wherein said discontinuing and resuming steps include operating a clutch which is operatively connected to a drive motor for the cutting wheel.

24. The method of claim 21 wherein the stream of sparks defines a first steam of sparks, and said urging step includes the flint rod impacting against the cutting wheel at a first portion of the cutting wheel and thereby causing cutting wheel wear at the first portion, and further comprising after said generating the first stream of sparks, adjusting the relative positioning of the flint rod and the cutting wheel such that when the flint rod is again urged against the rotating cutting wheel to generate a second stream of sparks, the flint rod impacts against the cutting wheel at a second portion of the cutting wheel and thus causes cutting wheel wear at the second portion which is spaced from the first portion, thereby extending the operating life of the cutting wheel.

25. The method of claim 21 wherein said urging step includes urging the flint rod with fluid pressure, and adjusting the fluid pressure and thereby the urging force.

26. The method of claim 21 further comprising adjusting the propelling fluid pressure to controllably adjust the size of the shower of sparks.

* * * * *